United States Patent [19]

Arvanigian

[11] 4,066,008

[45] Jan. 3, 1978

[54] CARTON FORMING MACHINE

[76] Inventor: George B. Arvanigian, 6846 Hickory Point Drive, Portage, Mich. 49002

[21] Appl. No.: 722,612

[22] Filed: Sept. 13, 1976

[51] Int. Cl.[2] ..... B31B 3/26

[52] U.S. Cl. ..... 93/49 R; 93/52

[58] Field of Search ..... 93/52, 49 R, 48, 45, 93/84 R, 36 R, 53 R

[56] References Cited

U.S. PATENT DOCUMENTS

| | | | |
|---|---|---|---|
| 2,108,334 | 2/1938 | Hayes | 93/52 |
| 2,291,063 | 7/1942 | Staude et al. | 93/49 R |
| 2,947,229 | 8/1960 | Caresio | 93/53 R |
| 3,388,641 | 6/1968 | Gobel | 93/49 R |
| 3,605,585 | 9/1971 | Borders | 93/52 |

*Primary Examiner*—James F. Coan

*Attorney, Agent, or Firm*—Blanchard, Flynn, Thiel, Boutell & Tanis

[57] ABSTRACT

A forming machine which permits a preformed corrugated board blank to be manually fed into one end of the machine, which blank has the rear flaps manually folded over and held until they are engaged by hold-down devices on the machine. The blank is moved through the machine by a drive belt and is sequentially acted upon by a folding structure which folds over the front corner tabs. A glueing device applies adhesive to the side flaps, and a further folding structure then folds over the side flaps for adhesive securement to the previously-folded corner flaps. The folding structure for the front corner tabs is nonpowered and includes levers for lifting the front tabs in response to movement of the tabs into engagement therewith, following which the front tabs are appropriately folded over while the side flaps pass beneath the lifting levers.

12 Claims, 14 Drawing Figures

CARTON FORMING MACHINE

FIELD OF THE INVENTION

This invention relates to an improved machine for forming knock-down preglued boxes from preformed blanks of stiff material, particularly corrugated board.

BACKGROUND OF THE INVENTION

Numerous machines have been devised for forming fold-down preglued boxes from preformed blanks. However, most of these prior machines have automatically performed all of the folding and glueing steps, and particularly have automatically folded both the front and rear corner tabs prior to glueing thereof to the side flaps. These machines have thus been unduly complex, both structurally and mechanically. These machines have also required elaborate control systems for ensuring proper timing and synchronization of the various manipulations. These machines have thus been undesirably costly, and undesirably complex to maintain and repair.

Many of the automated machines of the above-described type have also required the use of a special preformed blank utilizing corner tabs which project sidewardly through a greater (or lesser) extent than the side flaps in order to ensure that the front and particularly the rear tabs are properly folded. This thus increases the initial cost of the preformed blank since such blanks require substantially more cutting and result in substantial waste. Blanks of this type are also more difficult to handle and manipulate since the projecting corner tabs are more subject to damage. Machines which require such special blanks are disclosed in U.S. Pat. No. 1,868,572 and No. 2,108,334.

While some fold-down box-forming machines have been designed which utilize a conventional blank having corner flaps of the same width as the side flaps, nevertheless the complexities of these machines is even further increased by the necessity of having to provide complex control structure which must be activated and moved in timed relationship with the blank in order to permit proper folding of the rear corner tabs. This control structure greatly increases the cost and maintenance of the machine without significantly increasing the production rate or efficiency of the forming process. A machine of this general type is disclosed in British Specification No. 958,211. As this specification illustrates, movable control fingers are provided and moved in timed relationship with the blank movement so as to effect folding of the rear corner tabs. U.S. Pat. No. 2,125,147 and No. 2,911,889 also disclosure forming machines which require rotatable camlike control members which must be moved in synchronization with the blank to effect folding of the corner tabs.

Another disadvantage of known box-forming machines is that they are normally designed for handling only blanks formed from thin flexible board, specifically paper blanks. These machines, however, have been unable to successfully handle and form boxes from stiff corrugated board in view of the substantial strength and stiffness of same. The folding of corrugated blanks is a much more difficult operation since the blank does not readily flex, so that the only flexing of the blank takes place substantially about the fold lines. The folding structure associated with the known machines has required that the blank itself possess substantial flexibility, such as is present with paper blanks, whereby these machines have been unable to successfully accommodate blanks of corrugated board.

Accordingly, it is an object of the present invention to provide an improved machine for forming knock-down preglued boxes from preformed blanks, which machine overcomes the above-mentioned shortcomings. More particularly, it is an object of the present invention to provide:

1. A forming machine, as aforesaid, which permits the utilization of a standard blank having corner tabs and side flaps of the same width, and which permits the use of a blank formed from stiff corrugated board and permits its efficient formation into a knock-down preglued box.

2. A forming machine, as aforesaid, which provides an improved nonpowered folding structure for automatically folding the front corner tabs, whereby there is no need for associated control structure to synchronize the folding structure with the blank movement.

3. A forming machine, as aforesaid, wherein the folding structure involves simple swingable levers which automatically lift the front tabs upon engagement therewith so that the trailing side flaps automatically pass thereunder while the front tabs are being folded over. These automatically return, due to the urging of gravity, to their initial position upon completion of the folding step so as to be in position to engage the front tabs of the next blank.

4. A forming machine, as aforesaid, which permit preformed blanks to be manually fed into the machine with the rear corner tabs having been manually folded over, whereby the structure and operation of the machine is substantially simplified without significantly effecting the production rate and efficiency of the machine operation.

5. A forming machine, as aforesaid, which is substantially less expensive to both manufacture and maintain, which permits the successful formation of knock-down boxes from stiff blanks of corrugated board, which can be easily and accurately adjusted to accommodate blanks of different size, and which permits an efficient and rapid rate of production while requiring only minimal operation manipulation.

Other objects and purposes of the invention will be apparent to persons familiar with this technology upon reading the following specification and inspecting the accompanying drawings.

Figure 1:
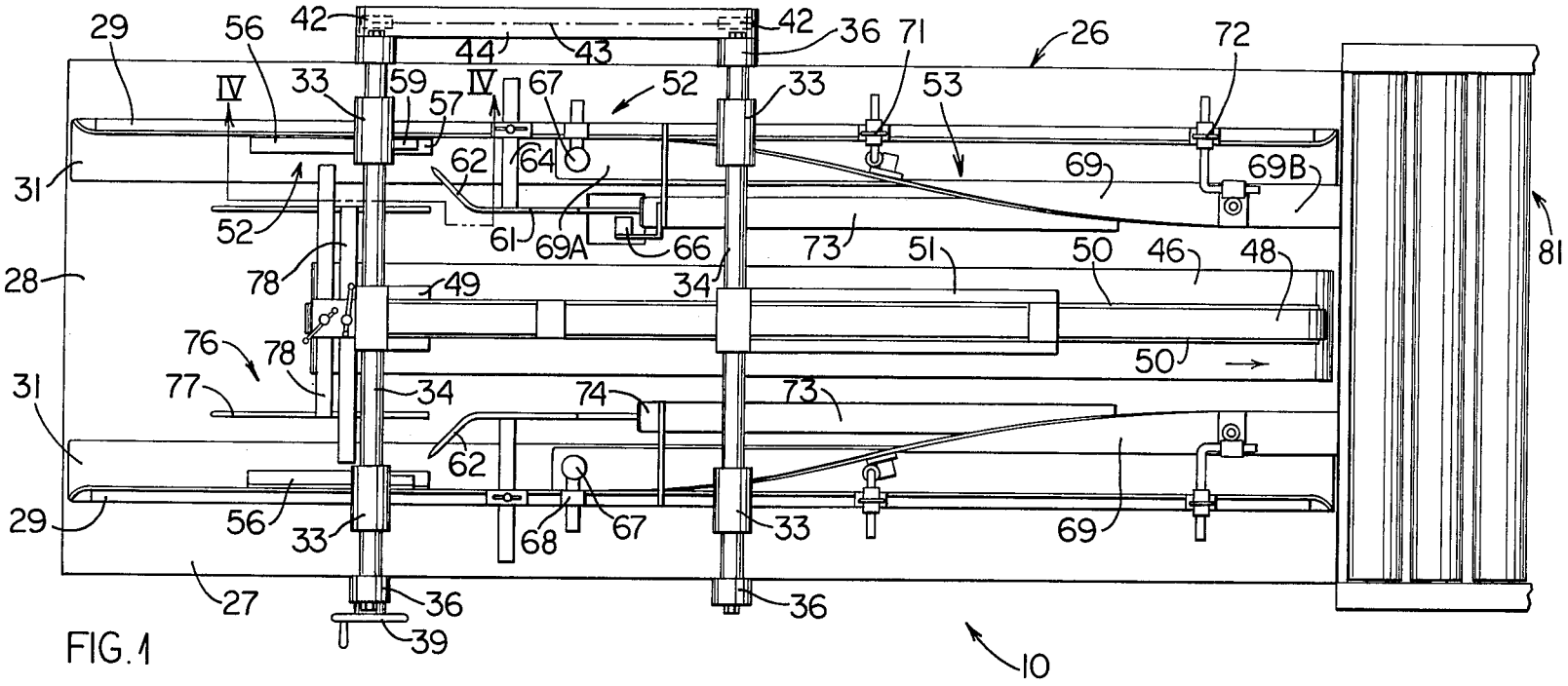
FIG. 1 is a top view of a forming machine according to the present invention.

Certain terminology will be used in the following description for convenience in reference only and will not be limiting. For example, the words "upwardly", "downwardly", "rightwardly" and "leftwardly" will refer to directions in the drawings to which reference is made. The word "forwardly" will refer to the feeding direction of the blank through the machine, which direction is rightwardly in FIG. 2. The words "inwardly" and "outwardly" will refer to directions toward and away from, respectively, the geometric center of the machine, the blank, and parts thereof. Said terminology will include the words specifically mentioned, derivatives thereof and words of similar import.

SUMMARY OF THE INVENTION

The objects and purposes of the present invention are met by providing a forming machine which permits a preformed corrugated board blank to be manually fed into one end of the machine, which blank has the rear flaps manually folded over and held until they are engaged by hold-down devices on the machine. The blank is moved through the machine by a drive belt and is sequentially acted upon by a folding structure which folds over the front corner tabs. A glueing structure applies adhesive to the side flaps, and a further folding structure then folds over the side flaps for adhesive securement to the previously-folded corner flaps. The folding structure for the front corner tabs is nonpowered and includes levers for lifting the front tabs in response to movement of the tabs into engagement therewith, following which the front tabs are appropriately folded over while the side flaps pass beneath the lifting levers.

DETAILED DESCRIPTION

Figure 2:
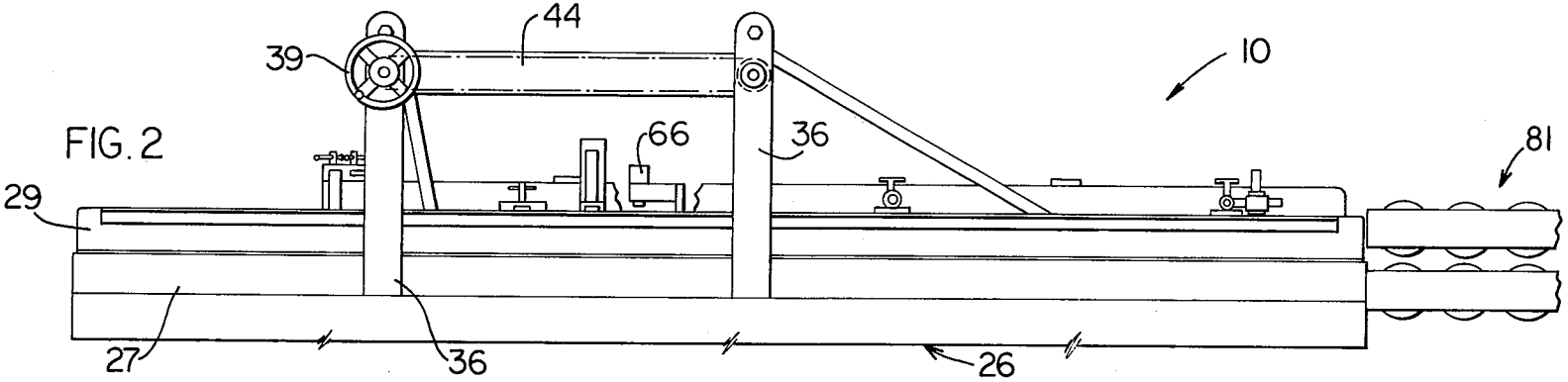
FIG. 2 is a fragmentary side elevational view of the machine shown in FIG. 1.
Figure 3:
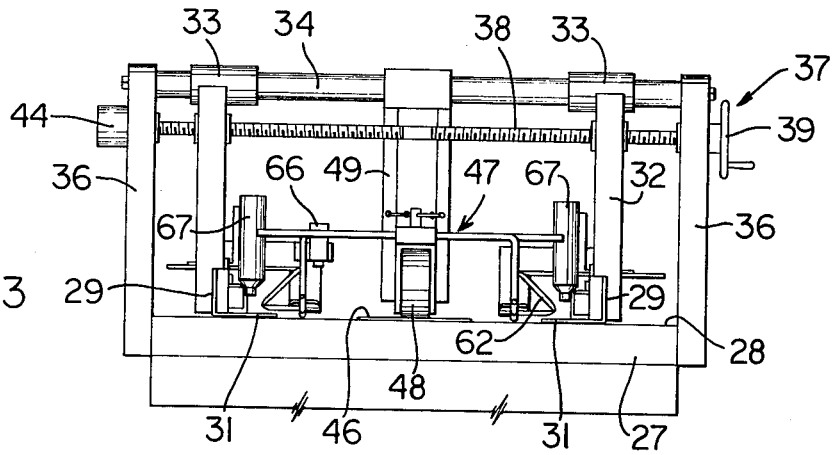
FIG. 3 is an end elevational view showing the inlet end of the machine, namely the leftward end in FIGS. 1 and 2.

Referring to FIGS. 1–3, there is illustrated a machine 10 for producing knock-down boxes from previously prepared blanks 11 (FIG. 8), which blanks are preferably formed from a heavy corrugated cardboard.

Figure 8:
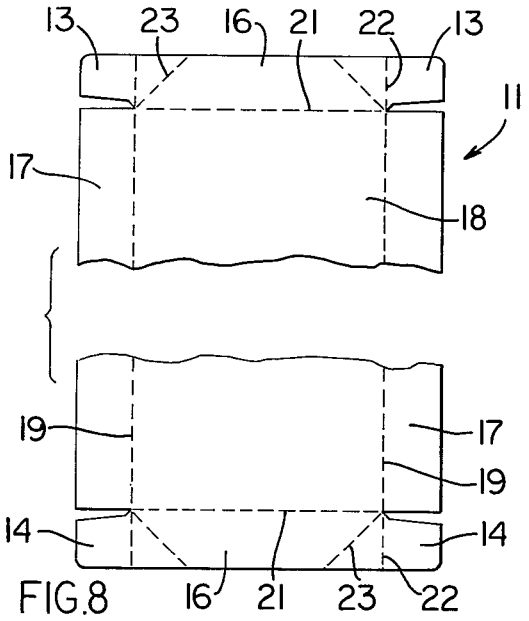
FIGS. 8 and 9 show the preformed blank and the resultant knock-down preglued box, respectively

The blank 11 is, as shown in FIG. 8, of a conventional construction and includes opposed pairs of front and rear corner tabs 13 and 14, respectively. Foldable end flaps 16 extend transversely between the corner flaps, and side flaps 17 extend longitudinally between the corner tabs. The blank also includes a center panel 18 which is separated from the side and end flaps by intermediate fold lines 19 and 21, respectively. The corner tabs 13 and 14 are integral with the end flaps 16 but separated therefrom by fold lines 22. Further, fold lines 23 are associated with the corner tabs, which fold lines extend at an angle of approximately 45° relative to the other fold lines. The fold lines 19, 21, 22 and 23 are all formed in a conventional manner during manufacture of the blank 11. The corner tabs 13 and 14 project sidewardly of the blank through distances equal to the width of the side flaps 17.

Figure 9:
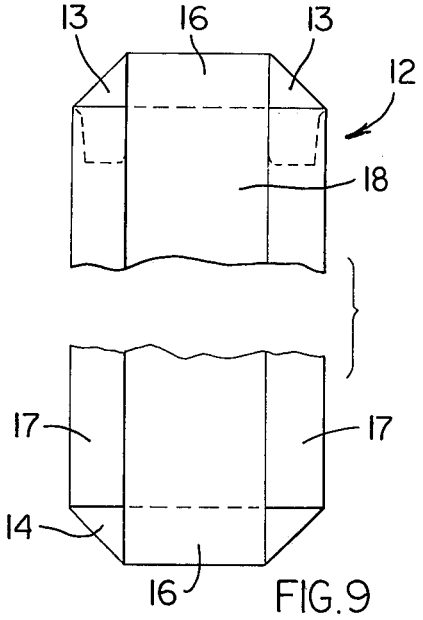
Figure 10:
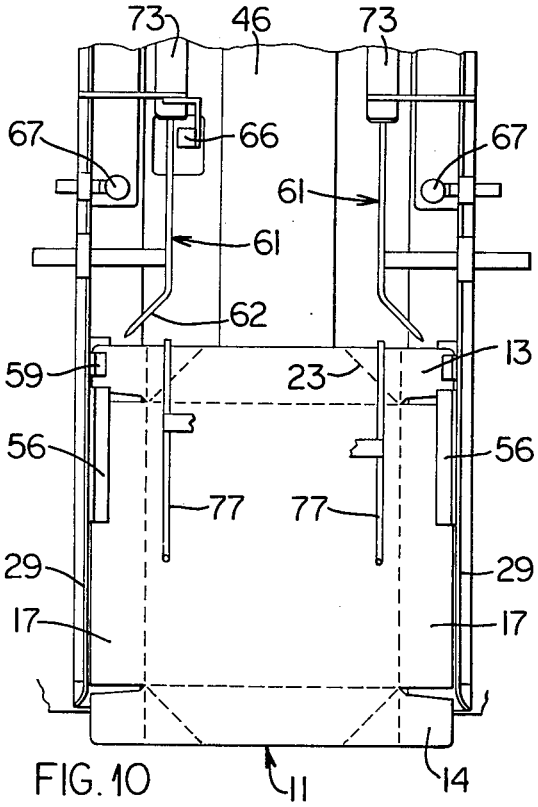
FIGS. 10–14 are fragmentary top views which show the progression of the blank through the machine and the progressive forming thereof into the knock-down preglued box.
Figure 12:
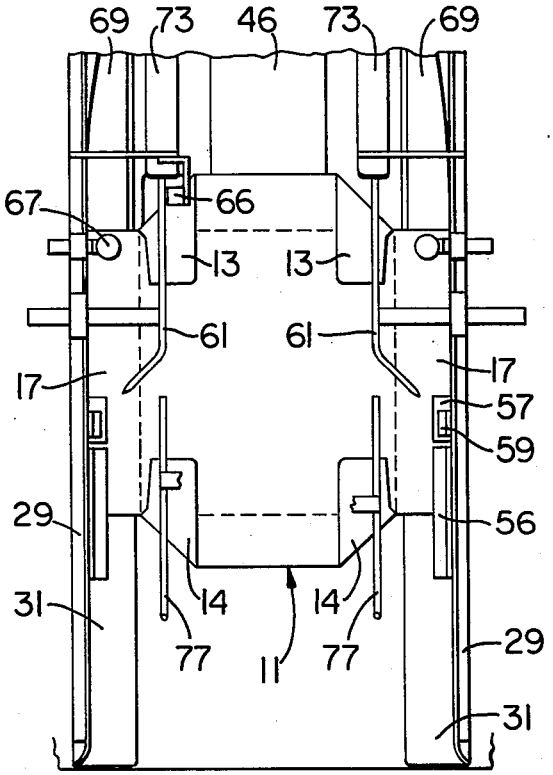

The machine 10 is designed for forming the blank 11 (FIG. 8) into a knock-down box or container 12, as illustrated in FIG. 12. In this knock-down condition, the corner tabs 13 and 14 are folded upwardly and inwardly about the fold lines 23 so as to partially overlap both the end flaps 16 and the center panel 18. The side flaps 17 are then folded inwardly so as to overlap the corner tabs, with the side flaps 17 being suitably adhesively secured to the corner tabs to thereby form an integral structure which, when opened from the collapsed condition of FIG. 9, results in a boxlike container.

The structure of such knock-down containers is well known, and the present invention is concerned solely with the machine 10 for forming the container from the preformed blank.

Referring now to FIGS. 1–3, the machine 10 includes a stationary frame 26 having a substantially horizontal support table 27 which defines an upper working surface 28. Table 27 supports a pair of opposed guide members 29 which are disposed in substantially parallel relationship and extend longitudinally of the machine. These guide members 29 are designed for confining the blank 11 therebetween as it travels the length of the machine. In the illustrated embodiment, these guide members 29 are L-shaped in cross section and have lower legs 31 which are slidably supported on the working surface 28 and project inwardly toward one another.

The guide members 29 are each fixably secured to a pair of upwardly projecting posts 32 which are provided with sleeves 33 on the upper ends thereof. A pair of stationary guide rods 34 extend transversely across and are spaced upwardly from the table and slidably support the sleeves 33 thereon. These guide rods 34 in turn are supported on uprights 36 which are fixed to and project upwardly from the sides of the table 27.

The guides 29 are equally spaced on opposite sides of the longitudinally extending centerline of the table 27, and are simultaneously movable toward or away from this centerline so as to adjust for blanks of different widths. For this purpose, there is provided an adjustment structure 37 which includes an elongated screw shaft 38 extending transversely across the table and positioned slightly below one of the support rods 34. This screw shaft 38 has right-hand and left-hand threads formed on the opposite end portions thereof, which threaded portions are in threaded engagement with a pair of directly opposed support posts 32. The screw shaft 38 has the outer ends thereof rotatably supported in suitable bearings which are mounted on the uprights 36. A hand wheel 39 is nonrotatably secured to one end of the screw shaft to permit selective rotation thereof.

The adjustment structure 37 also includes a further screw shaft 41 which is identical to the screw shaft 38 and extends between and is rotatably supported on the other pair of opposed uprights 36. The screw shaft 41 is in threaded engagement with the other pair of opposed support posts 32. The screw shafts 38 and 41 are connected for synchronous rotation by means of a suitable power transmission mechanism which, in the illustrated embodiment, comprises sprockets 42 which are nonrotatably secured to the ends of the screw shafts and are joined together by an endless chain 43. This sprocket-chain arrangement is suitably enclosed by a protective shroud 44.

The operation of the adjustment stucture 37 is believed readily apparent. When the guides 29 are to be simultaneously moved inwardly toward the longitudinal centerline of the table, so as to accommodate a narrower blank, hand wheel 39 is manually rotated in the desired direction to cause a corresponding rotation of the screw shafts 38 and 41, whereby the reversely threaded screw portions cause the posts 32 to be moved inwardly whereby the guides 29 are thus simultaneously displaced through equal amounts. Reverse rotation of the hand wheel 39 obviously causes simultaneous outward displacement of the guides 29 through equal amounts.

To move the blanks through the machine 10, same is provided with drive means in the form of an endless drive belt 46 which is disposed so that the upper reach thereof is substantially horizontal and projects slightly upwardly above the working surface 28. The belt 46, which moves in the direction of the arrow shown in FIG. 1, has the downstream end thereof (rightward end in FIG. 1) disposed closely adjacent the discharge end of the machine, whereas the upstream end of the drive belt is spaced inwardly a short distance from the end of the table. The drive belt 46 is supported on a pair of conventional pulleys which are rotatably supported on the frame, with one of the pulleys being driven from a conventional electric motor (not shown) through an intermediate gear mechanism or other suitable device. Such drive systems are conventional and hence require no further elaboration.

As shown in FIGS. 1 and 3, the drive belt 46 is substantially aligned with the longitudinal centerline of the table and has a width which is preferably only a small fraction of the table width.

To ensure that the blank is maintained adjacent the workpiece surface 28, and particularly in engagement with the driving belt 46, there is provided a hold-down device 47 which includes a further endless belt 48 disposed with its lower reach substantially parallel to but spaced slightly upwardly from the upper reach of the drive belt 46, whereby the blank is thus closely confined and engaged between these belts. This hold-down belt 48 extends throughout substantially the same length as the drive belt 46 and is also aligned with the longitudinally extending centerline of the table. Belt 48 is supported on a pair of conventional belt pulleys which are freely rotatably supported on a pair of opposed parallel side plates 50 which extend therebetween. These side plates in turn are rigidly secured to supports 49 and 51 which are mounted on and project downwardly from the rods 34. The hold-down belt 48 is thus a nonpowered belt, and will be movably displaced solely due to its engagement with the moving blank 11.

To permit forming of the fold-down box 12 from the blank 11, the machine 10 is provided with a tab folding structure 52 which coacts with the front tabs 14 for folding same when the blank is fed into the inlet end (leftward end in FIGS. 1 and 2) of the machine. This tab folding structure 52 is followed by a glueing means 53 for applying glue to the side flaps. Thereafter, the blank passes through a side-flap folding structure 54 which folds the side flaps 17 over onto the previously folded corner tabs to thereby adhesively glue same together. These structures will now be individually considered.

Figure 4:
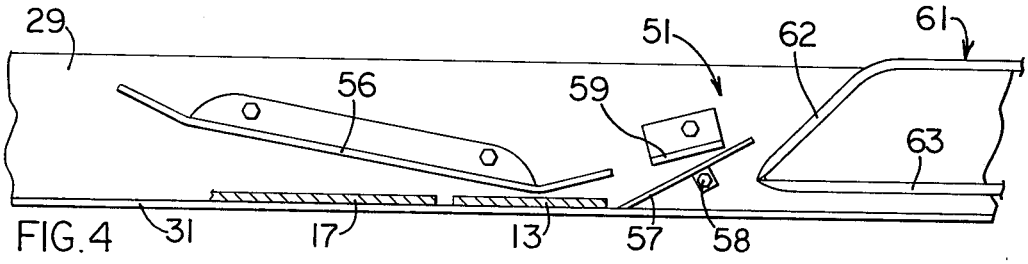
FIG. 4–7 are enlarged, fragmentary sectional views showing the front flap folding structure and the sequential movement of the blank therethrough, with FIG. 4 being taken along the line IV—IV in FIG. 1.
Figure 5:
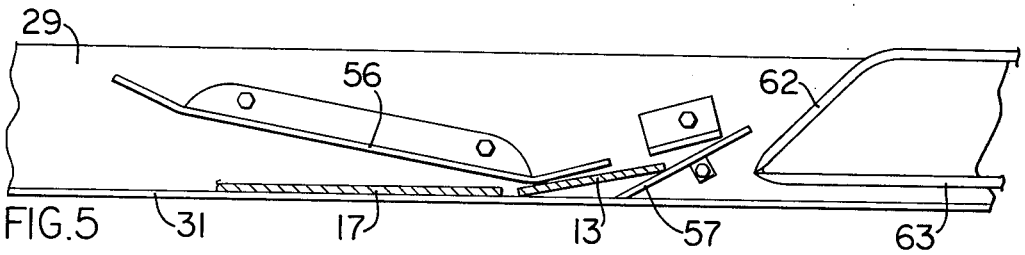
Figure 6:
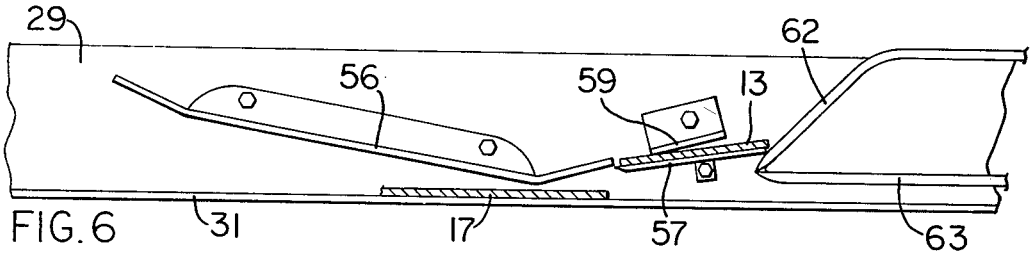

Considering first the front tab folding structure 52, same is disposed adjacent the inlet end of the machine and includes identical structures disposed adjacent opposite sides thereof for coaction with the tabs 13 located adjacent the opposite front corners of the blank. This tab folding structure includes a hold-down shoe 56 which is fixedly secured to the guide member 29 and is positioned slightly upwardly from and inclined with respect to the lower leg 31, thereby ensuring that the corner tabs and side flaps are maintained flat against the lower legs 31 when the blank is fed into the machine. A lifting lever 57 is positioned directly downstream of the hold-down shoe 56 and is pivotally mounted on the adjacent guide member 29 by a suitable hinge pin or bolt 58. Lever 57 is normally urged by gravity into a position wherein the downstream end thereof is maintained in engagement with the lower guide leg 31 substantially as illustrated in FIG. 4. This normal positional relationship of lever 57 can be achieved either by suitable counterweighting of the lever or by positioning the pivot 58 more closely adjacent the downstream end of the lever. The upstream end of the lever, where it engages the lower leg 31, is provided with a suitable bevel thereon so as to ensure a relatively smooth engagement with the lower leg 31 so that the front tab 13 may smoothly ride up the lever substantially as illustrated in FIG. 5. A stationary reaction member 59 is fixedly secured to the adjacent guide member 29 and is disposed directly above the lever 57 in the vicinity of the hinge 58. This reaction member 59 coacts with the lever 57 for confining the corner tab 13 therebetween (as shown in FIG. 6) to ensure a proper folding of the tab about the 45° fold line 23.

Figure 7:
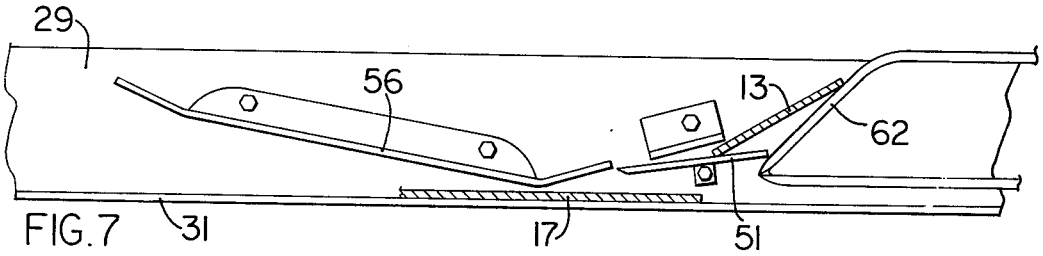

While the above-described parts of the folding structure 52 primarily result in lifting of the front corner tab 13, this structure 52 also includes a deflecting device 61 which is primarily responsible for the actual folding of the corner tab. This deflecting device 61 includes an upper deflecting rod 62 positioned with the upstream end thereof disposed closely adjacent the downstream end of the lever 57 so that the tab 13, when passing over the lever 57, is moved directly into engagement with the deflecting rod 62 as shown in FIGS. 6 and 7. The upper deflecting rod 62 has the upstream end thereof positioned closely adjacent the guide member 29 slightly above the leg 31, which rod 62 is angled inwardly and upwardly at an angle of approximately 45° as shown in FIGS. 1 and 3. After extending inwardly and upwardly at this angle for a selected distance, the reminder of the upper rod 62 extends horizontally in a direction parallel to the centerline of the machine until terminating in the region of the glueing means 53.

This deflecting device 61 also includes a lower hold-down rod 63 which extends horizontally and is positioned closely adjacent but slightly above the upper surface of the table. This rod 62 is substantially identical to the rod 62 in that it is disposed directly under the rod 62 and has an upstream portion which extends inwardly at an angle of 45° and terminates in a downstream portion which extends parallel to the longitudinal centerline of the machine. This lower hold-down rod 63 holds the front corner tab 13 in a folded-over condition wherein it is superimposed on the remainder of the blank after having been folded about the fold line 23.

The deflecting device 61, one of which is disposed adjacent each of the guide members 29, is provided with an elongated mounting arm 64 projecting sidewardly therefrom, which arm is secured to the adjacent guide member 29 by means of a suitable mounting clamp, such as a conventional screw-type clamp. The deflecting device 61 is thus adjustable transversely relative to the respective guide member 29 depending upon the size of the tabs and flaps on the blank. At the same time, since this folding structure 52 is mounted on the guide member 29, it will by automatically adjusted simultaneously upon adjustment of the guide member.

The glueing means 53 includes a pair of conventional glue guns 67 which are disposed on opposite sides of the machine for coaction with the flaps on opposite sides of the blank. These glue guns are directed with the discharge nozzles projecting downwardly for discharging a suitable adhesive on the blank at the desired locations. Each of the glue guns 67 has an adjustable mounting means 68 associated therewith and connected to the adjacent guide member 29 for permitting the glue guns to be adjusted transversely with respect to the longitudinal direction of the machine. The two glue guns 67 are positioned, in the illustrated embodiment, so as to deposit the glue directly on the side flaps 17 prior to folding of same. The two glue guns are initially activated by a conventional photocell-type light sensor 66 which senses the leading edge of the blank as it moves through the machine, whereby the glue guns discharge a predetermined amount of glue or adhesive on the side flaps 17 adjacent the leading edges thereof. A mechanical timer is associated with the glue guns 67 to activate same a second time so as to permit discharge of a further quantity of adhesive on the side flaps 17 adjacent the trailing edges thereof, which timing interval is adjusted in accordance with the rate of movement of the blank through the machine. The use of a timer in this manner is a conventional practice and is well understood by those familiar with this and other technologies.

Considering now the side flap folding structure 54, same includes a pair of elongated and twisted guide plates 69 which have the upstream or inlet ends 69A thereof positioned in the vicinity of the glue guns 67, whereas the downstream ends 69B are directly adjacent the discharge end of the machine. The inlet ends 69A are substantially horizontal and effectively overlie the lower legs 31 so that the side flaps 17 will thus pass onto the guide plates 69 after passing under the glue guns. Thereafter, the guide plates 69 make almost a 180° spiral twist as they extend longitudinally of the machine so that the discharge ends 69B are again in a position which approaches horizontal but are displaced inwardly from the adjacent guide members 29. These twisted guide plates 69 cause the side flaps 17, after glue has been deposited thereon, to be folded upwardly and inwardly through 180° so as to overlap the previously folded corner tabs. The structure and operation of these guide plates 69 is conventional in forming machines of this type.

The guide plates 69 are individually secured to the adjacent guide members 29 by mounting structures 71 and 72 which are spaced longitudinally of the machine and are adjustable to permit the guide members 69 to be displaced transversely.

To hold the corner tabs in a folded condition as the blank passes through the machine, same is provided with a pair of elongated platelike guide shoes 73 which extend longitudinally of the machine. These guide shoes 73, which have upwardly curved front ends 74, terminate adjacent but short of the discharge ends 69B of the guide plates 69. The blanks 11 are individually fed into the machine with the rear corner tabs 14 having been initially manually folded. Thus, a hold-down device 76 is provided adjacent the inlet end of the machine for maintaining these rear tabs 14 in their previously folded condition. This hold-down device 76 includes a pair of parallel rodlike hold-down members 77 which extend longitudinally of the machine adjacent the inlet end thereof. These hold-down rods 77 have upwardly turned nose portions at the inlet ends thereof to facilitate the feeding of the corner flaps thereunder, and the downstream ends of these rods are located in the vicinity of the deflecting devices 61. The rods 77 are substantially aligned with the longitudinally extending straight portions of the hold-down rods 63. Mounting arms 78 are secured to the rods 77, which arms 78 are in turn fixedly but adjustably connected to the stationary support 49, as by means of a screw clamp, for permitting the transverse position of the hold-down rods 77 to be selectively adjusted.

A conventional roller-type pressing device 81 is preferably disposed adjacent the discharge end of the machine 10 so that the folded, glued, knock-down box as discharged from the machine 10 is fed directly into the roller press 81 which securely presses the folded and adhesively connected tabs and flaps together. Such roller presses 81 are conventional and comprise no part of the present invention.

OPERATION

While the operation of machine 10 is believed apparent from the above description, same will nevertheless be briefly described to ensure a complete understanding thereof.

To form the knock-down box 12 from the blank 11, the operator initially folds over the rear corner tabs 14 about the fold lines 23 and holds them in this folded condition. The front end of the box is then manually fed into the machine with the front corner tabs 13 and side flaps 17 being held down by the hold-down shoes 56 as shown in FIG. 4. The blank is pushed manually into the machine until the leading edge of the blank is engaged between the belts 46 and 48, at which time the lower drive belt 46 moves the blank longitudinally along the machine. The operator continues to hold the rear corner tabs 14 in the folded-over condition until they are moved under the hold-down rods 77, as shown in FIG. 12, at which time the operator can then pick up a further blank for insertion into the machine.

Figure 11:
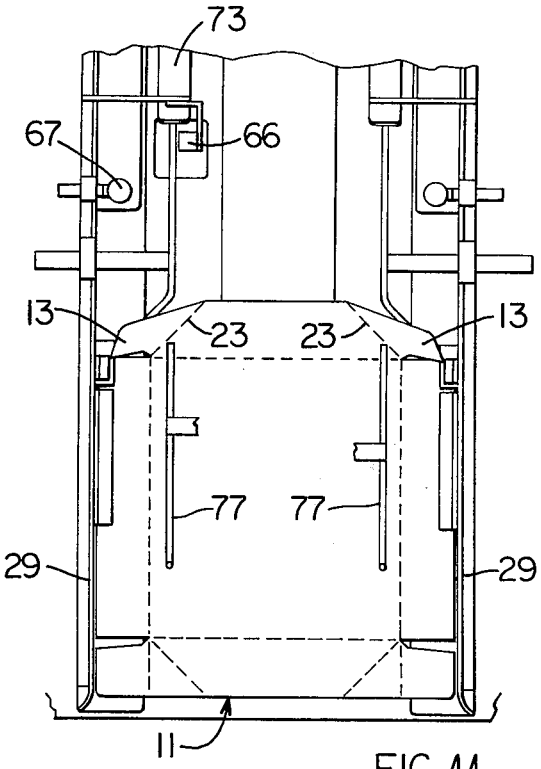

As the blank moves longitudinally through the machine, the front corner tabs 13 move up the lifting levers 57 as shown in FIG. 5 and consequently cause these levers 57 to pivot upwardly into the position shown in FIG. 6. Further movement of the blank into the position shown in FIGS. 7 and 11 causes the front corner tabs 13 to be bent upwardly about the fold lines 23 due to engagement of the tabs 13 with the inclined deflecting rods 62. During this upward movement into the positions shown in FIGS. 6 and 7, the upper reaction member 59 prevents the outer corner of tab 13 from improperly bending upwardly and thereby assures that the complete tab is lifted upwardly and folded about the line 23. When the tab 13 is being folded by the deflecting rod 62, as shown in FIG. 7, the lever 57 is still maintained in its raised condition so that the side flap 17 thus passes thereunder and is accordingly not folded. Continued movement of the blank through the machine from the position shown in FIGS. 7 and 11 causes the front corner flaps 13 to be completely folded over through an angle of 180° so that they thus overlie the center panel 18, with the front corner tabs 13 being maintained in this folded position by the lower hold-down rods 63 substantially as shown in FIG. 12. The corner tabs are continually maintained in this position by the hold-down guide shoes 73 as the blank moves thereunder.

Figure 13:
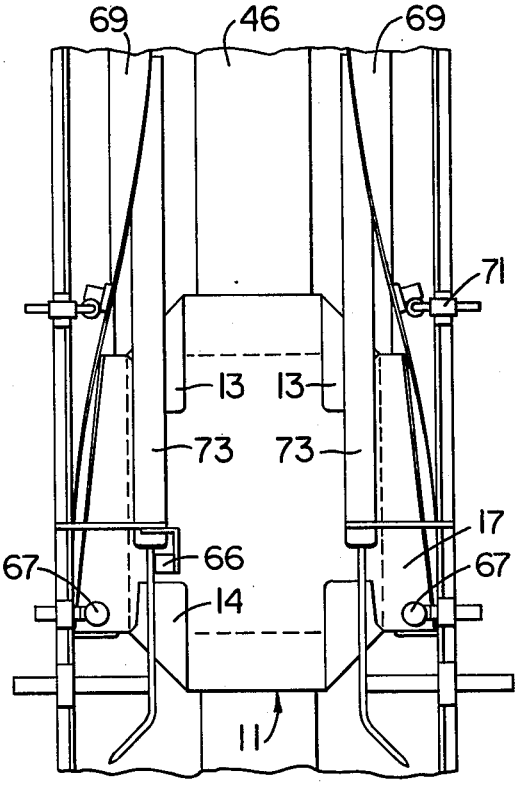

When the blank reaches the position shown in FIG. 12, in which position the front corner tabs 13 have already been folded, the light sensor 66 senses the leading edge of the blank and thereby activates the glue guns 67 which accordingly discharge a preselected quantity of glue or adhesive on the side flaps 17 adjacent the leading edge thereof. This initial energization of the glue guns also activates the timer associated therewith so that a preselected time interval is accordingly timed out during which the blank moves from the position shown in FIG. 12 to the position shown in FIG. 13, in which latter position the glue guns are now disposed over the side flaps 17 adjacent the trailing edges thereof. At this time, the glue guns are activated for a second time so that a predetermined quantity of glue or adhesive is again discharged onto the side flaps 17.

Figure 14:
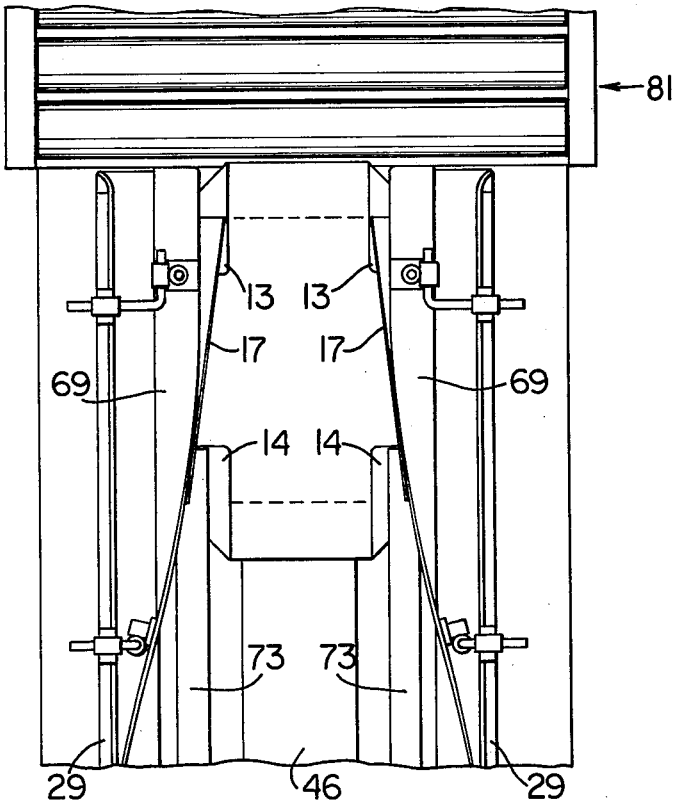

Further movement of the blank past the glue guns causes the leading edges of the side flaps 17 to be engaged with the spirally twisted guide plates 69 so that the side flaps are thus gradually folded upwardly and inwardly so as to overlap the center panel 18. When the leading edge of the blank approaches the discharge end of the machine, as shown in FIG. 14, the guide shoes 73 no longer separate the folded side flaps from the previously folded corner flaps, whereupon the side flaps are thus forced downwardly into engagement with the corner flaps and are adhesively connected together. The blank is then discharged directly into the roller press 81 which tightly presses the knock-down box together so that a secured glue connection between the side flaps and corner tabs is thus achieved. The knock-down box 12 is then discharged from the roller press and can be supplied directly to a suitable stacking apparatus if desired.

While the invention discloses the glue guns being positioned for discharging the glue on the side flaps prior to folding thereof, it will be appreciated that the glue could be discharged onto the folded corner tabs if desired, although this requires that the hold-down devices be designed so as to avoid engagement with the glue deposited thereon. Thus, depositing of the glue directly on the side flaps is preferred.

The above description relates to utilization of the machine for forming a knock-down box of the telescope type, that is, the type which utilizes two separate knock-down boxes which are telescoped one within the other for forming a closed container. Nevertheless, it will be appreciated that the machine is equally applicable for forming knock-down boxes of the fold-over type. Such fold-over boxes are provided with additional fold lines across the central panel so as to result in two separate panels which ultimately form the top and bottom walls of the box when same is folded over, and the side flaps are also appropriately cut so as to have dual side flaps which overlap when the box is snapped into its open condition and folded over to form a closed container.

Although a particular preferred embodiment of the invention has been disclosed in detail for illustrative purposes, it will be recognized that variations or modification of the disclosed apparatus, including the rearrangement of parts, lie within the scope of the present invention.

The embodiment of the invention in which an exclusive property or privilege is claimed are defined as follows:

1. In an apparatus for forming a knock-down preglued box from a preformed blank having a center panel, a pair of opposed foldable side flaps, a pair of opposed foldable end flaps, and opposed pairs of front and rear foldable corner tabs which are connected to and project sidewardly from the opposite edges of the end flaps, the improvement comprising:

frame means;

elongated guide means mounted on said frame means and defining an elongated path along which said blank is moved, said guide means including a pair of substantially parallel guide members which are transversely spaced apart for slidably guiding the opposite edges of the blank therebetween;

drive means extending longitudinally of said path for moving said blank therealong;

first folding means disposed adjacent the inlet end of said path for automatically folding the front corner tabs upwardly so as to partially overlap the center panel as the blank is moved along said path by said drive means, said first folding means being non-powered and comprising a pair of identical folding devices which are positioned adjacent the opposite sides of said path in the vicinity of said guide members;

each said folding device including a tab lifting lever supported for pivotal movement about a substantially horizontal axis, said tab lifting lever being normally urged by gravity into a lower position wherein the lever extends upwardly at an acute angle relative to the direction of movement of the blank so that the upstream end of the lever projects into the path of movement of the front corner tab as the blank advances along the path from the inlet end thereof, said lever being hinged about an axis positioned above said path so that said front corner tab engages said lever when in said lower position and swingably displaces the upstream end thereof into an upper position which results in said front corner tab being lifted upwardly above the remainder of the blank while permitting the trailing side flap to freely pass beneath the lever;

each said folding device also including a stationary reaction member positioned directly above and slightly spaced from said lifting lever for confining the front corner tab therebetween;

each said folding device further including a stationarily positioned folding element disposed directly downstream of said lever for engaging the front corner tab after it has been lifted by said lever and folding same over so as to at least partially overlap said central panel;

hold-down means disposed directly downstream of said folding element for engaging and holding the front corner tab in its folded-over position;

adhesive applying means positioned downstream of said first folding means for applying adhesive to one of said side flaps or said folded corner tabs; and second folding means positioned downstream of said first folding means and coacting with the opposed side flaps for folding the side flaps upwardly and inwardly so as to overlap said central panel and the previously folded corner tabs.

2. An apparatus according to claim 1, including stationary guiding elements disposed directly adjacent the guide members and positioned slightly upstream of said lifting levers for maintaining the front corner tabs and side flaps in proper position whereby the front corner tabs engage the levers when in their lower position, said stationary guiding elements being positioned so as to pass over the upper side of the blank along the opposite longitudinally extending edges thereof.

3. An apparatus according to claim 2, wherein said guide members are adjustable relative to said frame means to selectively vary the transverse distance therebetween so as to accommodate blanks of different width.

4. An apparatus according to claim 3, including a pair of elogated hold-down members positioned directly adjacent the inlet end of said apparatus and upstream of said first folding means, said hold-down members being spaced inwardly from the opposite guide members and extending in the longitudinal direction of the path for holding the rear corner tabs in a folded position due to said blank being fed into the apparatus with the rear corner tabs having been prefolded.

5. An apparatus to claim 3, further including adjustment means interconnected to said opposed guide members for simultaneously moving same inwardly or outwardly in opposed relationship to one another for varying the transverse spacing therebetween, said drive means including an elongated endless driving belt extending longitudinally of said apparatus along said path, said driving belt having the upper reach thereof disposed substantially horizontally and positioned centrally between said guide members, and a hold-down device positioned directly over said driving belt for maintaining the blank in engagement therewith, said hold-down device including an endless hold-down belt having the lower reach thereof disposed substantially horizontally and positioned closely adjacent but directly above the upper reach of said driving belt for permitting the blank to be closely confined therebetween, said hold-down belt being freely movably supported.

6. In an apparatus for forming a knock-down preglued box from a preformed blank having a center panel, a pair of opposed foldable side flaps, a pair of opposed foldable end flaps, and opposed pairs of front and rear foldable corner tabs which are connected to and project sidewardly from the opposite edges of the end flaps, the improvement comprising:

frame means;

elongated guide means movably supported on said frame means and defining a horizontally elongated path along which the blank is moved, said guide means including a pair of elongated parallel guide rails which are horizontally spaced apart and are slidably supported on said frame means for slidable movement toward and away from one another to vary the transverse spacing therebetween;

said guide rails being of an L-shaped cross section at least adjacent the inlet end of said apparatus, each guide rail including a vertically projecting leg for slidably guiding an edge of the blank and a horizontally projecting leg fixedly connected to and projecting inwardly from the vertical leg adjacent the lower end thereof, the horizontal legs of said opposed guide rails projecting inwardly toward one another and defining thereon upper horizontal support surfaces for slidably guiding said blank;

adjustment means drivingly interconnected between said guide rails for simultaneously moving same in opposite directions to selectively vary the transverse spacing therebetween;

folding means disposed adjacent but spaced inwardly from the inlet end of said apparatus for engaging the front corner tabs and folding same upwardly so as to partially overlap the center panel as the blank is movably displaced along said guide rails, said folding means including a pair of identical folding devices which are spaced adjacent the opposite sides of said path and are individually mounted on the respective guide rails;

a pair of adhesive-applying devices mounted on said guide rails at a location downstream of said folding means, each said adhesive device including a downwardly directed discharge nozzle for directly adhesive onto one of the side flaps of the blank;

sensing means positoned for sensing the leading edge of the blank as it is moved along said path for activating said adhesive devices; and side flap folding structure disposed downstream of said adhesive devices for engaging the side flaps and folding same upwardly so as to overlap the center panel and the previously folded corner tabs, said folding structure including a pair of folding members disposed for engaging the flaps on the opposite side of said blank, each of said folding members being mounted on a respective one of said guide rails.

7. An apparatus according to claim 6, wherein each said folding device includes a lifting lever pivotly supported for swinging movement about a substantially horizontal pivot axis which extends substantially perpendicular to said elongated path, said lifting lever being normally maintained in a lowered position wherein the upstream end of the lever is disposed lowermost, whereby said lever defines a ramp-like surface which projects upwardly at a small acute angle relative to the direction of movement of the blank.

8. An apparatus according to claim 6, wherein said frame means includes a support table having an upwardly directed horizontal surface, said pair of guide rails being slidably supported on said horizontal surface, said frame means also including upright means projecting upwardly above said horizontal surface on opposite sides of said table, said upright means being joined together by a pair of elongated parallel guide rods which extend transversely across the table in perpendicular relationship to the direction of movement of the blank, and said guide rails being fixedly connected to upwardly projecting supports which are slidably supported on said rods for permitting said guide rails to be slidably displaced relative to said table to thereby vary the transverse spacing therebetween.

9. An apparatus according to claim 8, wherein each said folding device includes a lifting lever pivotally supported on one of said guide rails, said lifting lever being mounted adjacent the vertical leg of said guide rail for swinging movement about a substantially horizontal pivot axis, said lifting lever being normally maintained in a lowered position wherein the upstream end of the lever is disposed lowermost and is engaged with the horizontal leg of said guide rail, whereby said lever defines a ramplike surface which projects upwardly at an acute angle relative to said horizontal leg as measured in the direction of movement of the blank.

10. An aparatus according to claim 7, wherein each said folding device also includes a stationary reaction member positioned above the respective lifting lever for confining the front corner tab therebetween.

11. In an aparatus for forming a knock-down preglued box from a preformed blank having a center panel, a pair of opposed foldable side flaps, a pair of opposed foldable end flaps, and opposed pairs of front and rear foldable corner tabs, the improvement comprising:

frame means;

elongated guide means mounted on said frame means and defining an elongated path along which said blank is moved;

drive means extending longitudinally of said path for moving said blank therealong;

first folding means disposed adjacent said path for automatically folding the front corner tabs upwardly so as to partially overlap the blank as it is moved along said path by said drive means, said first folding means being nonpowered and comprising a pair of identical folding devices which are positioned adjacent the opposite sides of said path for simultaneously engaging and folding the pair of front corner tabs;

each said folding device including tab deflecting lever means supported for pivotal movement about a substantially horizontal axis which extends substantially perpendicular to the direction of movement of the blank, said tab deflecting lever means being normally maintained in a first position wherein the upstream end of the lever means projects into the path of movement of the front corner tab as the blank advances along said path from the inlet end thereof, whereby engagement of said front corner tab with said lever means as said blank is advanced along said path causes said lever means to be swingably displaced into a second position wherein the front corner tab is displaced vertically from the path so that the remainder of the blank can freely pass by the lever means on the side thereof which is opposite the front corner tab;

each said folding device also including a stationarily positioned reaction structure positioned closely adjacent but slightly vertically spaced from the respective lever means for confining the front corner tab therebetween;

each said folding device further including a folding element disposed directly downstream of said lever means for engaging a front corner tab after it has been deflected by said lever means and folding same over so as to at least partially overlap said blank;

hold-down means disposed directly downstream of said folding element for engaging and holding the front corner tab in its folded-over position;

means positioned downstream of said first folding means for applying adhesive to one of said flaps or said folded corner tabs; and second folding means positioned downstream of said first folding means and coating with an opposed pair of said flaps for folding same upwardly and inwardly so as to overlap said center panel and the previously folded corner tabs.

12. An apparatus according to claim 11, wherein the pivot axis for said lever means is vertically displaced from the path of movement of the blank, and wherein said lever means when in said first position projects at an acute angle relative to the direction of movement of the blank.

* * * * *